US006443552B1

(12) United States Patent
Inoue et al.

(10) Patent No.: US 6,443,552 B1
(45) Date of Patent: Sep. 3, 2002

(54) CARRIAGE MOVING APPARATUS, RECORDING APPARATUS AND READING APPARATUS

(75) Inventors: Hiroyuki Inoue; Koh Hasegawa, both of Yokohama; Takashi Nojima, Tokyo; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/652,210

(22) Filed: Aug. 30, 2000

(30) Foreign Application Priority Data

Sep. 1, 1999 (JP) ..... 11-247095

(51) Int. Cl.[7] ..... B41J 19/20
(52) U.S. Cl. ..... 347/37
(58) Field of Search ..... 197/82; 347/4, 347/37, 139; 400/635, 320, 323, 335, 59, 55

(56) References Cited

U.S. PATENT DOCUMENTS

| | | | | | |
|---|---|---|---|---|---|
| 4,084,681 | A | * | 4/1978 | Heinzl et al. | 197/37 |
| 4,723,129 | A | | 2/1988 | Endo et al. | 347/56 |
| 4,740,796 | A | | 4/1988 | Endo et al. | 347/56 |
| 5,200,767 | A | * | 4/1993 | Tsukada et al. | 347/37 |
| 5,465,107 | A | * | 11/1995 | Mayo et al. | 347/37 |
| 5,801,728 | A | | 9/1998 | Yanagi et al. | 347/50 |

FOREIGN PATENT DOCUMENTS

JP 6-47978 2/1994

* cited by examiner

*Primary Examiner*—Anh T. N. Vo
(74) *Attorney, Agent, or Firm*—Fitzpatrick, Cella, Harper & Scinto

(57) ABSTRACT

A carriage moving apparatus for transmitting a driving force to a carriage by a toothed timing belt, and reciprocally moving the carriage includes the projected portions of the belt protruding on the opposite sides of the timing belt. The projected portions of the belt have their central axes passing through substantially the center of the widthwise cross-section of the timing belt and are engaged with a carriage engaging portion formed on the carriage.

21 Claims, 8 Drawing Sheets

CARRIAGE MOVING APPARATUS, RECORDING APPARATUS AND READING APPARATUS

BACKGROUND OF THE INVENTION

1. Field of the Invention

This invention relates to a carriage moving apparatus for transmitting a driving force to a carriage by a toothed timing belt to thereby reciprocally move the carriage, and a recording apparatus and a reading apparatus using the same, respectively.

2. Related Background Art

In a so-called serial recording apparatus wherein a recording head is carried on a carriage and recording is effected on a recording medium while the carriage is moved, an image is formed on the recording medium while the conveyance of the recording medium and the recording effected with the movement of the carriage are alternately repeated.

The carriage which is main scanning means of the serial type is usually driven by a belt from a drive source such as a motor through pulleys. This belt is usually mounted by two pulleys, and in order to prevent the slack thereof, tension is applied thereto by the pulley on one side.

In order to effect main scanning of higher accuracy, it is generally practiced to prevent bad recording such as slip by the use of a so-called toothed timing belt and toothed timing pulleys which are a belt and pulleys provided with uneven shapes.

There have heretofore been various methods of coupling the timing belt and carriage in such a recording apparatus, and in any of these coupling methods, the belt and carriage are coupled together so that no backlash may be present in that portion of the carriage which is coupled to the belt.

FIG. 8 of the accompanying drawings schematically shows the construction of the belt-coupled portion of a recording apparatus according to the prior art. The belt-coupled portion 101 having a concavity is formed integrally on a carriage 100, as shown, and the concavity has an expause somewhat wider than the thickness of a timing belt 103. One of convex portions defining the concavity is formed with unevenness so as to mesh with the teeth of the timing belt 103, and the timing belt 103 is inserted into the concavity and cylindrical pins 104 are forced thereinto, whereby the timing belt 103 is fixed to the carriage 100.

A method of coupling the concavity of the belt-coupled portion 101 and the timing belt 103 together is such that the timing belt 103 made of an elastic material such as rubber is urged by the fixing pins 104, whereby the carriage 100 and the timing belt 103 are coupled together so that there may be no backlash.

However, such a method of coupling the timing belt 103 and the carriage 100 together in the recording apparatus according to the prior art suffers from the following problems.

In the driving system by the timing belt 103, the timing belt 103 is vibrated by the vibration of a carriage motor which is the drive source of the carriage 100 or the timing belt 103 is vibrated by vibration caused when the toothed timing pulleys and the timing belt 103 mesh with each other. This vibration is sometimes transmitted to a recording head carried on the carriage 100 because the carriage 100 is firmly fixed. This causes bad recording and causes the production of noise such as the resonation of parts incorporated in the carriage 100.

Particularly when a stepping motor is used as the carriage driving motor, the vibration during driving tends to occur.

So, Japanese Patent Application Laid-Open No. 6-47978 proposes a construction as shown in FIG. 9 of the accompanying drawings. That is, a carriage 100 is provided with a coupling hole portion 100*a* which is formed so as to permit a belt-coupled portion 101 to be loosely fitted therein. Also, unevenness is formed on the belt-coupled portion 101 so as to mesh with the unevenness of a timing belt 103, and a gap for inserting the timing belt 103 thereinto is provided in the belt-coupled portion 101 with the same width as that of the timing belt 103. The timing belt 103 is inserted into this gap, whereafter the belt-coupled portion 101 coupled to the timing belt 103 is further inserted into the coupling hole portion 100*a* of the carriage 100.

The belt-coupled portion 101 is all or partly formed by a molded article or a member having elasticity. By the belt-coupled portion 101 being thus formed by an elastic member, it is made difficult for the vibration of a carriage driving motor transmitted by the timing belt 103 to be transmitted to the carriage, whereby good image formation is realized.

Also, the belt-coupled portion 101 is loosely fitted in the coupling hole portion 100*a* provided in the carriage, and this portion also serves to absorb the transmitted vibration.

However, when adopting the construction as described In Japanese Patent Application Laid-Open No. 6-47978, the following problems have been found in obtaining Images of higher dignity,y That is, the belt-coupled portion 101 is loosely fitted to the carriage 100 and therefore, when the carriage 100 is stopped, the backlash of the fitting may affect the stopped position of the carriage. Particularly in this construction, there is a distance between the timing belt engaging portion of the belt-coupled portion and the fitted portion of the belt-coupled portion to the carriage and therefore, an angular moment is applied to the belt-coupled portion 101 and the backlash is increased, and this tends to increase the influence upon the stopped position of the carriage.

If the stopped position of the carriage becomes unstable by such backlash and the choice of the carriage driving construction is mistaken, for example, in an ink jet recording apparatus, the carriage cannot be stopped at a predetermined location due to the presence of the aforementioned backlash when the carriage is to be stopped at the predetermined location in order to bring a cap for protecting the nozzle of a recording head into close contact with the periphery of the nozzle, and leak occurs between the cap and the nozzle and the nozzle dries, and this leads to the possibility that the ink jet recording head becomes incapable of discharging ink.

SUMMARY OF THE INVENTION

It is an object of the present invention to provide a carriage moving apparatus which can prevent vibration transmitted from a vibration source such as a motor by a timing belt from transmitting to a carriage, and enhance the stoppage accuracy of the carriage and avoid any inconvenience by the instability of the stopped position of the carriage, and a recording apparatus and a reading apparatus using the same.

It is another object of the present invention to provide a carriage moving apparatus which can reliably effect engagement between a timing belt and a carriage, and a recording apparatus and a reading apparatus using the same.

It is still another object of the present invention to provide a carriage moving apparatus for transmitting a driving force to a carriage by a toothed timing belt to thereby reciprocally move the carriage, which is designed such that belt projected portions provided on the timing belt and having their central axes passing through substantially the widthwise center of the timing belt, and protruding to the opposite sides with the timing belt interposed therebetween are engaged with a carriage engaging portion formed on the carriage.

DESCRIPTION OF THE PREFERRED EMBODIMENTS

A carriage moving apparatus according to an embodiment of the present invention, and a recording apparatus and a reading apparatus provided with the same, respectively, will now be described with reference to the drawings.

First Embodiment

Reference is had to FIGS. 1 to 4A through 4C to describe a serial recording apparatus to which a carriage moving apparatus according to the present invention is applied.

General Construction of the Recording Apparatus

Figure 1:
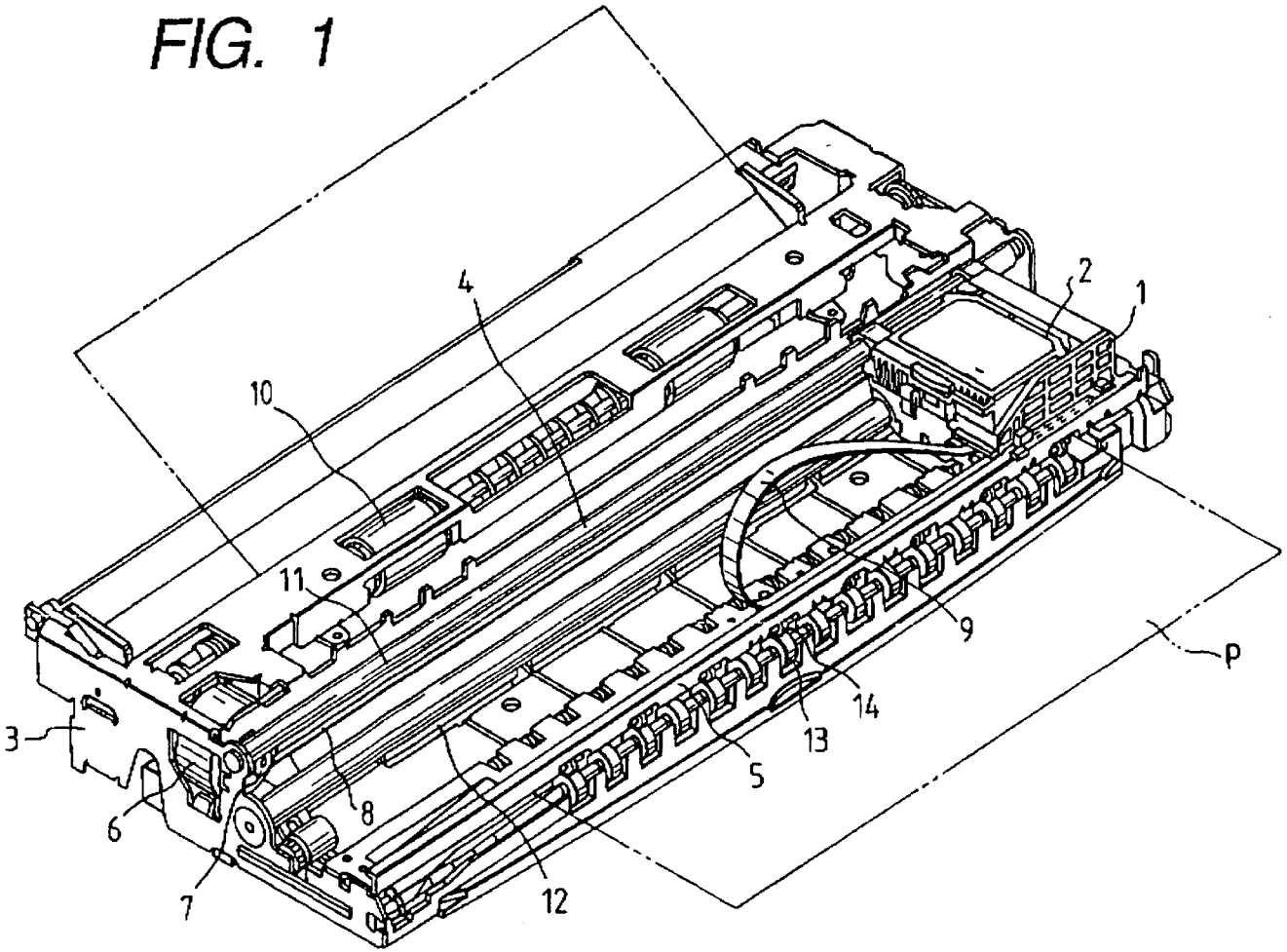
FIG. 1 is a general perspective view of a recording apparatus.

Reference is first had to FIG. 1 to describe the general construction of the recording apparatus. FIG. 1 is a general perspective view of the recording apparatus.

The recording apparatus according to the present embodiment is an ink jet recording apparatus for discharging ink to a recording medium to thereby form an image, and a carriage 1 removably carries thereon a recording head cartridge 2 comprising an ink tank and a recording head made integral with each other, and is supported on a guide shaft 4 and a guide rail 5 having their opposite end portions fixed to a frame 3 and disposed parallel to each other, for sliding movement in a direction intersecting with the conveyance direction of a recording medium P and parallel to the plane of the recording medium P. Also, the carriage 1 is engaged with a region of a timing belt 8 passed over a driving pulley 7 secured to the output shaft of a carriage driving motor 6 and a rotatably journalled driven pulley (not shown), and by the carriage driving motor 6 being driven, the timing belt 8 may be rotated and the carriage 1 may be reciprocally moved in the aforedescribed direction.

The recording head has a plurality of ink discharge nozzle rows, and selectively discharges ink from the nozzles in conformity with an image signal transmitted through a flexible cable 9 to thereby effect recording on the recording medium P. Discharge heaters are present in the nozzles of the recording head according to the present embodiment, and these heaters may be selectively electrically energized, whereby film boiling created in the ink may be utilized to create a bubble and discharge the ink. As regards the typical construction and principle thereof, it is desirable to use the basic principle disclosed, for example, in U.S. Pat. No. 4,723,129 and US. Pat. No. 4,740,796.

Also, provision is made of conveying means for conveying the recording medium P to the carriage moving area (recording area). This conveying means comprises a pickup roller 10, a conveying roller 11 and a pinch roller 12 urged against the conveying roller 11, these being provided on one side (the upstream side with respect to the conveyance direction of the recording medium) of the recording area, and a discharge roller 13 and a spur 14 urged against it, these being provided on the other side (the downstream side with respect to the conveyance direction of the recording medium). The spur 14 is of a star shape, and the tip ends of the star shape are sharp edges and therefore, the spur is a roller which does not rub and stain an image even if a recorded recording medium passes it.

The recording medium P is conveyed by these rollers, and an image is formed on the recording medium P while this conveyance and the recording effected with the movement of the carriage 1 are alternately repeated.

Engagement Construction of the Carriage and the Timing Belt

Figure 2:
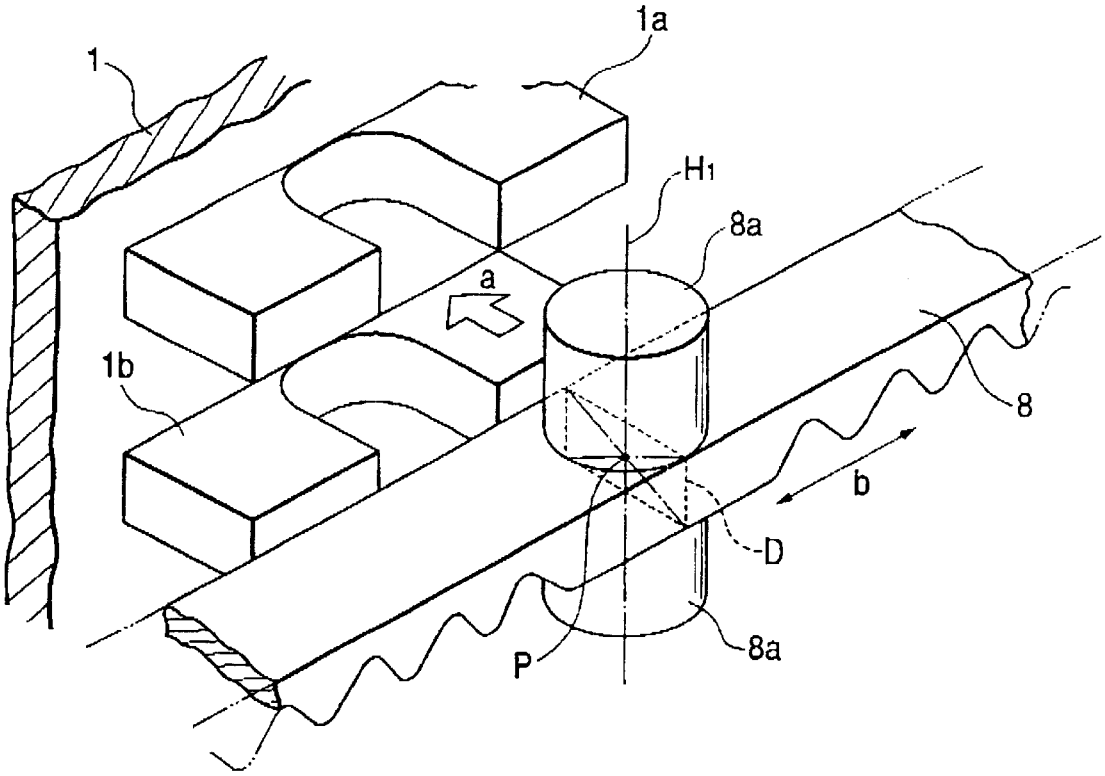
FIG. 2 is a perspective view of the engagement portion between a carriage and a timing belt.
Figure 3A:
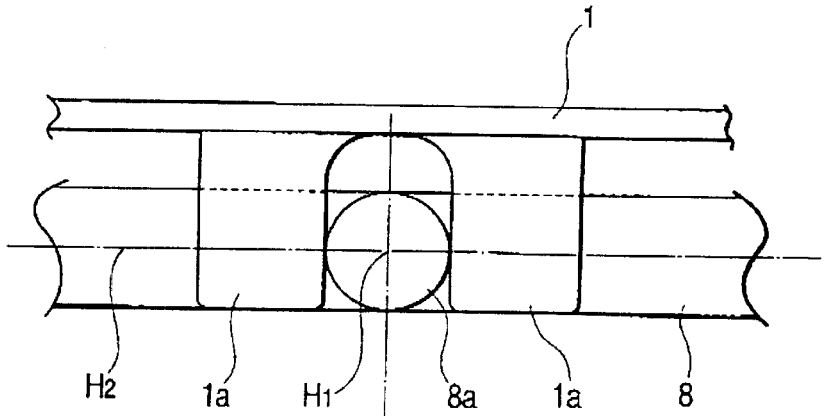
FIGS. 3A and 3B are a plan view and a side view, respectively, showing a state in which the timing belt is mounted on the carriage.
Figure 3B:
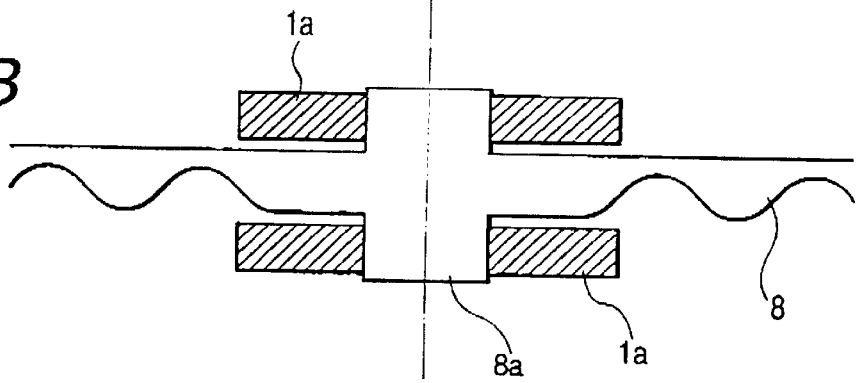
Figure 4A:
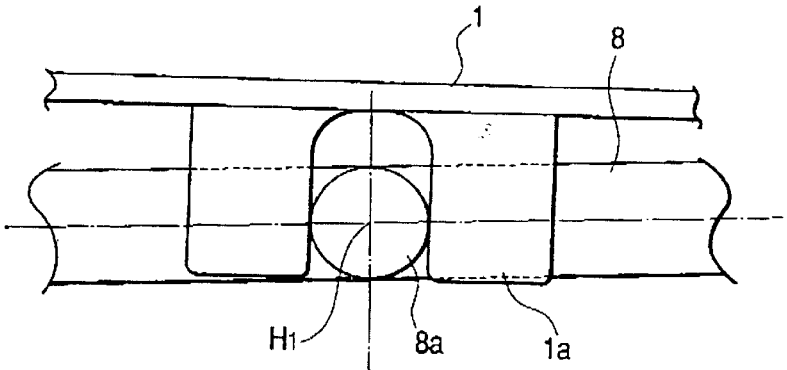
FIGS. 4A, 4B and 4C are plan views showing a state in which the timing belt is inclined, a state in which a swollen portion is provided on the projected portion of the belt, and a state in which the projected portion of the belt is compressed and sandwiched, respectively.
Figure 4B:
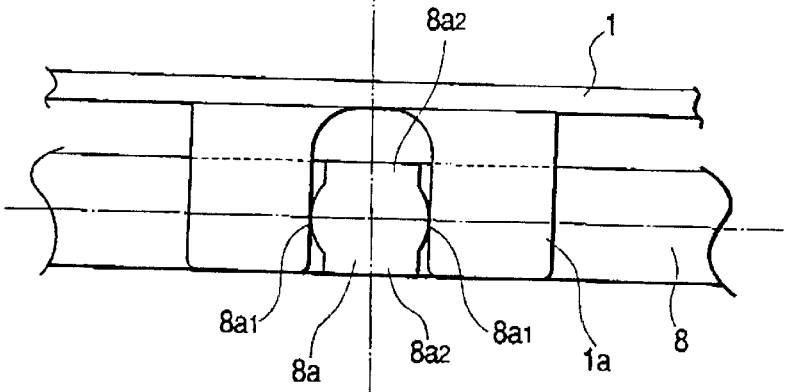
Figure 4C:
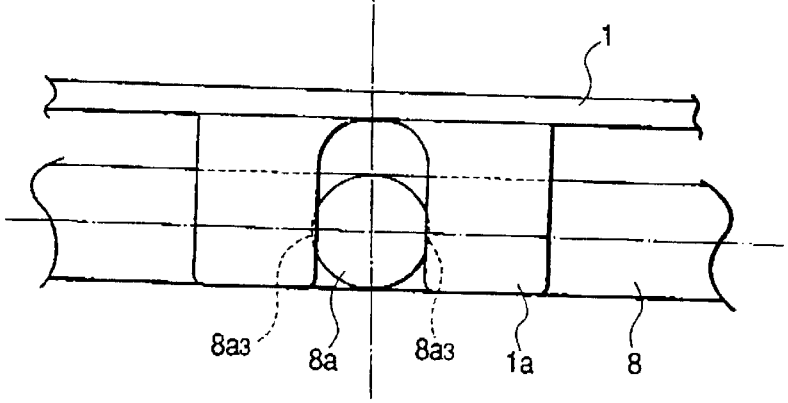

A construction for coupling the carriage 1 and the timing belt 8 together will now be described with reference to FIGS. 2 to 4A through 4C. FIG. 2 is a perspective view of the engaged portion of the carriage and the timing belt, FIGS. 3A and 3B are a plan view and a side view, respectively, showing a state in which the timing belt is mounted on the carriage, and FIGS. 4A, 4B and 4C are plan views showing a state in which the timing belt is inclined, a state in which a swollen portion is provided on the projected portion of the belt, and a state in which the projected portion of the belt is compressed and embraced, respectively. Also, the carriage 1 is simply shown as a plate.

The timing belt 8 is inserted in the direction of arrow a in FIG. 2 relative to the carriage engaging portion la provided on the side of the carriage 1 and is engaged with the carriage 1. The timing belt 8 is provided with cylindrical bosses 8*a* as the projected portions of the belt vertically having substantially the same central axis $H_1$, and these bosses 8*a* are inserted in the engaging portion 1*a* provided on the carriage 1. The carriage engaging portion 1*a* is of a slit shape in which the bosses 8*a* are fitted, and embraces the upper and lower bosses 8*a*.

The timing belt 8 is formed of an elastic material such as rubber or elastomer, and the bosses 8*a* are formed integrally with this belt. Therefore, the carriage 1 is engaged through the bosses 8*a* which are elastic members. With such a construction, vibration transmitted from a vibration source such as a motor to the timing belt 8 is absorbed by the elastic members, and it becomes very difficult for the vibration to be transmitted to the carriage 1. As the result, the irregularity by the vibration does not occur to a recorded image, and a good image can be obtained.

The bosses 8*a* are provided at a position having substantially the same center line vertically of the timing belt S. That is, as shown in FIG. 2, the central axis $H_1$ of the bosses

8*a* passes through the center P of the cross-section D of the timing belt in the widthwise direction of the timing belt 8 (the direction orthogonal to the movement direction (the direction of arrow b) of the timing belt 8), and the projected portions thereof are provided so as to protrude toward the toothed surface side of the timing belt 8 and the back side opposite to the toothed surface. As shown in FIG. 3A, the arcuate portions of the bosses 8*a* contact with the engaging portion 1*a* of the cartridge 1, and by this portion of contact, the force from the timing belt 8 is adapted to be transmitted to the carriage 1.

As described above, the central axis $H_1$ of the bosses 8*a* is substantially coincident with the central axis $H_2$ of the timing belt 8 and therefore, no angular moment is applied to the timing belt 8. Thus, during the transmission of motive power from the timing belt 8 to the carriage 1, the carriage 1 has no backlash and the stopped position of the carriage 1 is secured highly accurately Also, the bosses 8*a* and the engaging portion 1*a* are in contact with each other in the arcuate portions and therefore, the area of contact therebetween becomes small and the vibration transmitting force becomes very small.

Further, as shown in FIG. 4A, the bosses 8*a* and the engaging portion 1*a* are in contact with each other in the arcuate portions of the bosses 8*a* and therefore, even if the timing belt 8 is in engagement with the carriage 1, the timing belt 8 can freely rotate about the bosses 8*a*. Therefore, even if there is a movement in a direction deviating from the movement direction of the carriage in the timing belt 8, the stress by that movement is not applied to the carriage 1, and also in this point, the vibration transmission preventing effect of the carriage 1 becomes higher.

Since the transmission of motive power from the timing belt 8 to the carriage 1 is effected only by the bosses 8*a*, a great force is applied to the bosses 8*a*. So, if the portions of contact between the bosses 8*a* and the carriage engaging portion 1*a* are arcuate, the shape of the other portions can be made into a shape which can freely secure strength. As shown, for example, in FIG. 4B, arcuate portions 8*a*1 contacting with the carriage engaging portion 1*a* may be formed on the bosses 8*a* and a swollen portion 8*a*2 may be formed in the other portion thereof than the scanning direction of the carriage to thereby enhance the strength of the bosses 8*a* and prevent the damage or the like when the bosses 8*a* receive an excessively great force due to the reversal or the like of the carriage 1.

Also, in FIG. 4C, the interval between the boss embracing portions of the engaging portion 1*a* is made smaller than the thickness (or diameter) of the bosses 8*a* in the scanning direction of the carriage, whereby the bosses Ba may be compressed (as indicated by broken lines 8*a*3) and mounted on the carriage 1.

According to an experiment, it has been confirmed that when the bosses 8*a* are given moderate compression as previously described, the transmission of vibration can be restrained better. The amount of compression is set to an appropriate value in the relation with the thickness of the bosses 8*a* in the scanning direction of the carriage and the hardness of the bosses 8*a* formed of an elastic material (the hardness of the timing belt 8). Experimentally, it has been confirmed that when the aforementioned amount of compression is within the range of 0.5 to 30% relative to the length of the bosses 8*a* in a direction parallel to the scanning direction of the carriage and the hardness of the bosses 8*a* is within the range of 60° to 80° (by the measuring method for rubber hardness shown in JIS (Japan Industrial Standard) A), a very high vibration absorbing property is exhibited.

Second Embodiment

A second embodiment of the engagement construction of the carriage 1 and the timing belt 8 will now be described with reference to FIGS. 5 to 7A through 7C. Here, description will be made chiefly of the differences of the present embodiment from the aforedescribed first embodiment, and portions which will not be especially described are similar in construction to those in the first embodiment.

Figure 5:
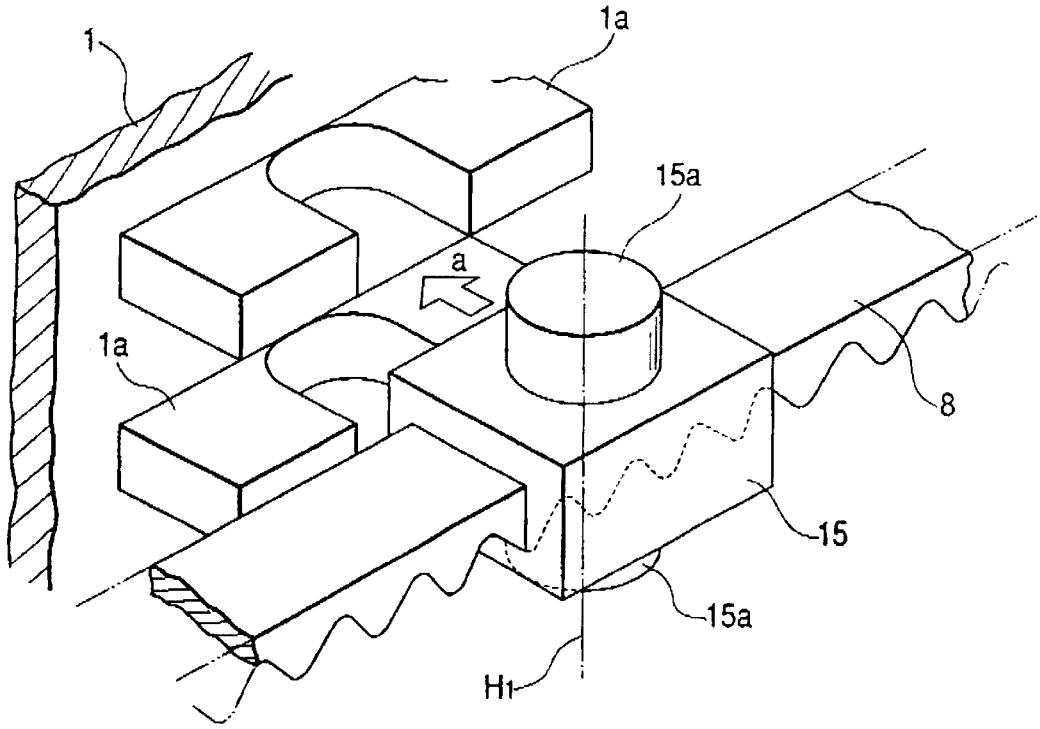
FIG. 5 is a perspective view of the engagement portion between the carriage and the timing belt.
Figure 6A:
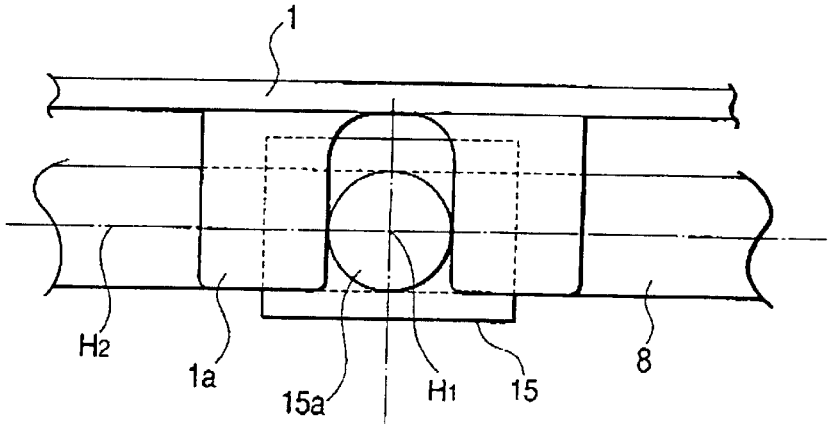
FIGS. 6A and 6B are a plan view and a side view, respectively, showing a state in which the timing belt is mounted on the carriage.
Figure 6B:
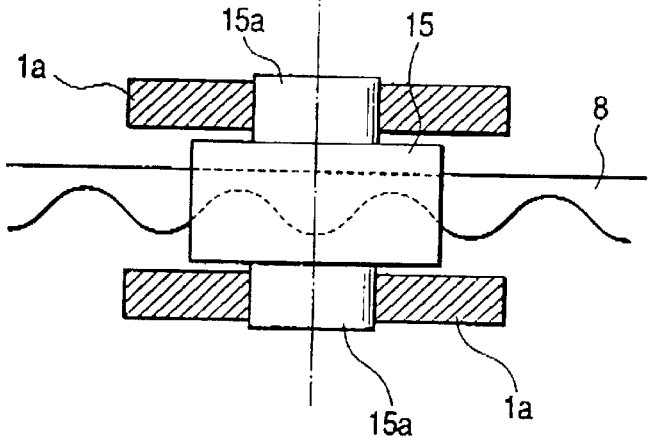

FIG. 5 is a perspective view of the engagement portion between the carriage and the timing belt, and FIGS. 6A and 6B are a plan view and a side view, respectively, showing a state in which the timing belt is mounted on the carriage. In FIG. 5, a belt holding member 15 is secured to the timing belt 8. Bosses 15*a* as the projected portions of the belt vertically having substantially the same central axis $H_1$ are provided on this belt holding member 15, and the belt holding member 15 is secured to the timing belt 8 so that the central axis $H_1$ of the bosses 15*a* may substantially coincide with the central axis $H_2$ of the timing belt 8. As in the aforedescribed first embodiment, the bosses 15*a* are inserted into the engaging portions 1*a* provided on the carriage 1 to thereby bring the two into engagement with each other. The engaging portions 1*a* are of a slit shape in which the bosses 15*a* are fitted, and embrace the upper and lower bosses 15*a*, respectively.

Figure 7A:
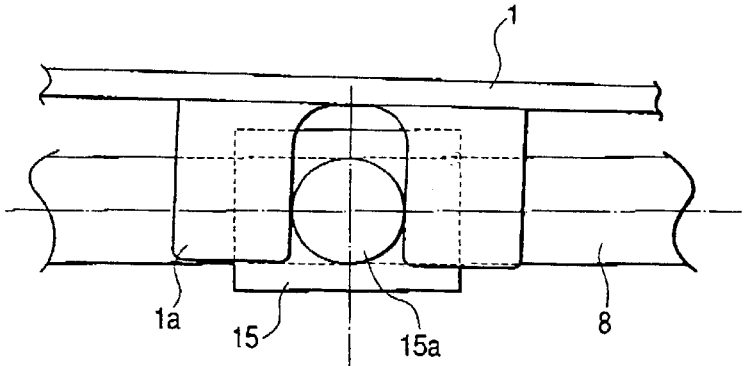
FIGS. 7A, 7B and 7C are plan views showing a state in which the timing belt is inclined, a state in which a swollen portion is provided on the projected portions of the belt, and a state in which the projected portions of the belt are compressed and embraced, respectively.
Figure 7B:
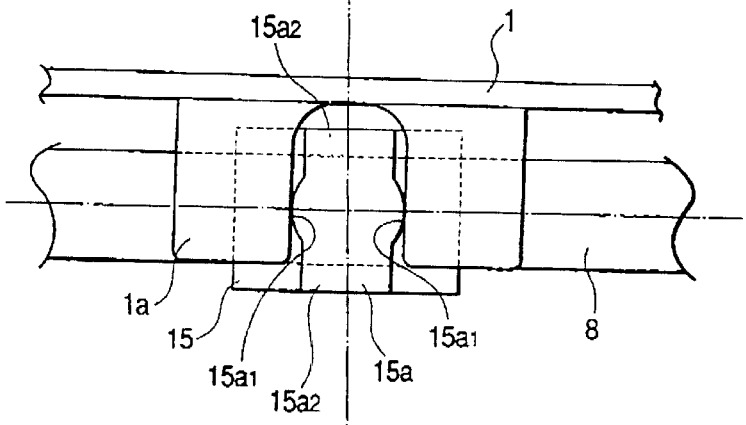
Figure 7C:
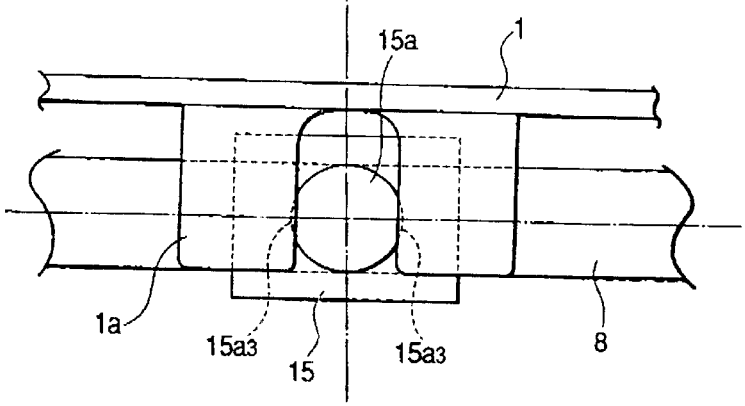
Figure 8:
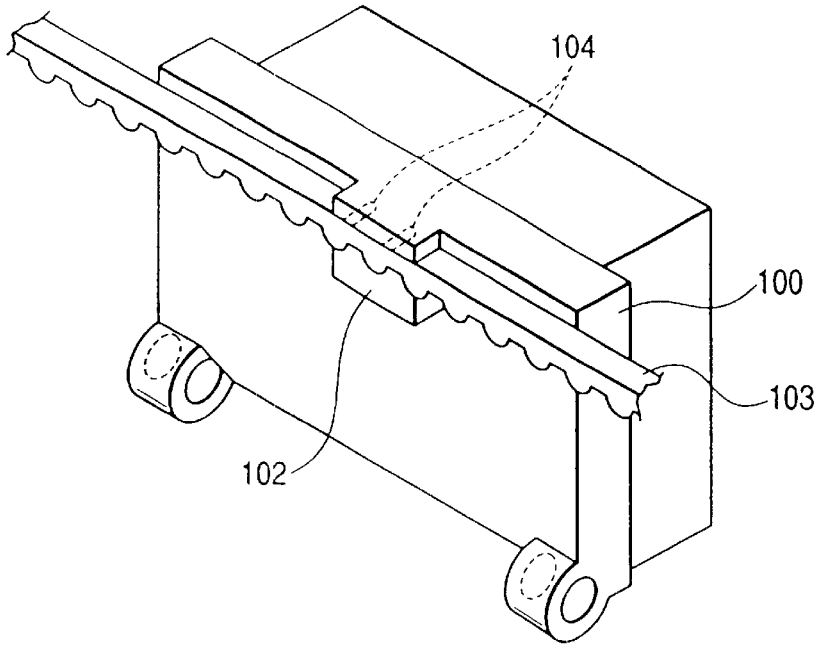
FIG. 8 (PRIOR ART)
FIG. 8 is a view of the prior art.
Figure 9:
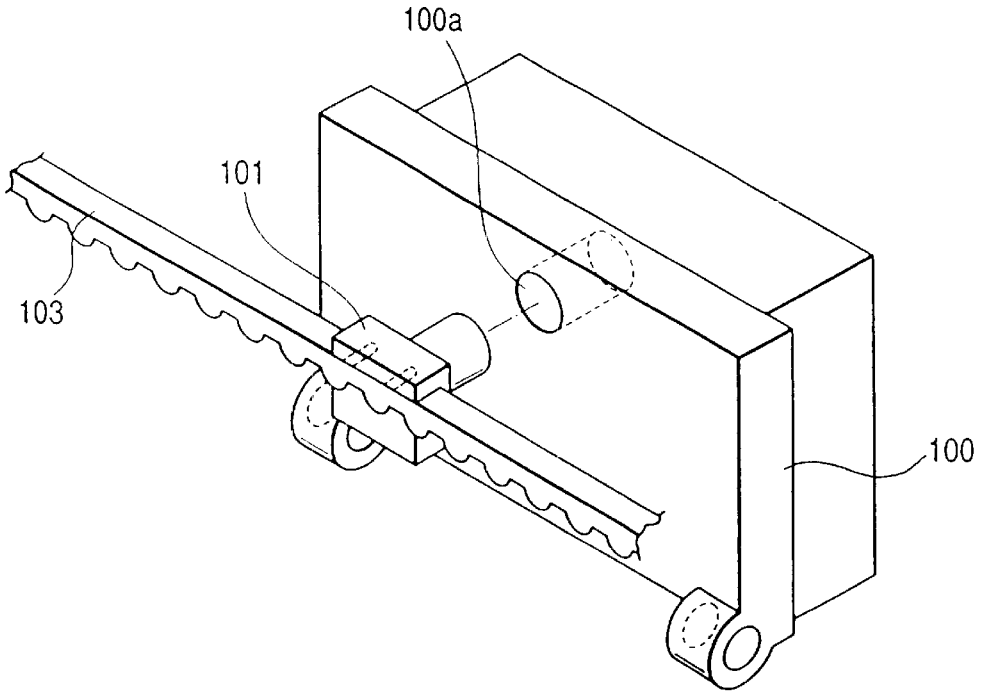
FIG. 9 (PRIOR ART)
FIG. 9 is a view of the prior art.

The engagement construction of the bosses 15*a* and the carriage engaging portions 1*a*, as shown in FIGS. 7A to 7C, may be a construction in which the boss 15*a* is of an arcuate shape (see FIG. 7A), a construction in which the boss 15*a* is provided with arcuate portions $\mathbf{15}a_1$ and a swollen portion $\mathbf{15}a_2$ (see FIG. 7B), or a construction in which the boss 15*a* is compressed (as indicated by broken line $\mathbf{15}a_3$) when engaged with the carriage engaging portions 1*a* (see FIG. 7C). The constructions of FIGS. 7A to 7C are the same as those described with reference to FIGS. 4A to 4C and therefore need not be described any further.

The belt holding member 15 is formed of an elastic material such as rubber or elastomer, and the bosses 15*a* are formed integrally with this belt holding member 15 and therefore, the bosses 15*a* also are elastic members of the same material as the belt holding member 15. Accordingly, the timing belt 8 is engaged with the carriage 1 through the belt holding member 15 formed of an elastic material and the bosses 15*a* integral therewith and formed of an elastic material. Thereby, as in the first embodiment, it becomes very difficult for the vibration of the vibration source such as a motor to be transmitted to the carriage 1, and the irregularity by the vibration does not occur to recorded images, and good images can be obtained.

Here, a method of manufacturing the belt holding member 15 adoptes the integral molding by outsert molding or the like to the timing belt 8. Generally, the timing belt is made by a method of twining a core wire formed of glass or alamide on an inner mold, twining a rubber plate of CR rubber or the like around it, and further applying pressure and heat thereto from around it and vulcanizing the rubber, or a method of pouring thermosetting urethane resin or the like into a casting mold comprising an inner mold and an outer mold, and applying heat to it and hardening it. The timing belt 8 made In that manner is thrown Into a mold for molding the belt holding member 15, and the belt holding member 15 and the timing belt 8 are molded integrally with each other. When molded thus, the belt holding member 15 wraps the timing belt 8 and therefore, even if the belt holding member 15 is a belt holding member having elasticity like that of rubber or elastomer, there is no opening through which the timing belt slips out, and the timing belt does not come off the belt holding member even if there is the deformation because of the plastic material.

Further, the belt holding member 15 is fixed to the timing belt 8 so as not to deviate from each other in the scanning direction of the carriage 1, i.e., the movement direction of the timing belt B. The timing belt 8 is formed with teeth, and the belt holding member 15 is molded integrally therewith so as to wrap these teeth and therefore, the belt holding member 15 is formed with unevenness corresponding to the teeth of the timing belt 8, and these mesh with each other to thereby prevent the above-mentioned deviation.

However, when a relatively excessively great force in the scanning direction of the carriage is applied to the timing belt 8, the unevenness corresponding to the teeth of the timing belt 8 sometimes rides over the teeth of the timing belt 8 because the belt holding member 15 is an elastic member. This is because as previously described, the timing belt 8 is usually formed of chloroprene or rubber such as urethane, and when in contrast, the integrally formed belt holding member 15 is made of a material differing from that of the timing belt, the two are basically not adhesively secured to each other and therefore the surfaces of the timing belt 8 and the belt holding member 15 easily peel off from each other. In this case, the relative position of the timing belt 8 and the belt holding member 15 deviates.

In a serial type recording apparatus, the carriage 1 scans from left to right and is reciprocally moved, but when the carriage 1 is reversed, great acceleration acts on the carriage 1 and deviation is liable to occur between the timing belt 8 and the belt holding member 15 as described above. Particularly, in recent years, there is the tendency to adopt a timing belt 8 formed with teeth of a small pitch in order to reduce the fluctuation of the speed during the movement of the timing belt attributable to the error of the meshing engagement between the teeth of the timing belt 8 and the teeth of a timing pulley. In this case, generally the height of the teeth of the timing belt 8 becomes small and therefore, the timing belt 8 becomes liable to deviate relative to the deformation of the belt holding member 15.

Also, in order to mitigate the movement load of the carriage by the rigidity of the timing belt 8 to thereby lower the power consumption of a carriage driving motor, or mitigate the fluctuation of the speed of the timing belt 8 by a load to thereby enhance the dignity of recorded images, there is the tendency to narrow the width of the teeth of the timing belt 8, i.e., the width of the timing belt 8. This leads to a reduction in costs and therefore has rapidly come to be often used in recent years. However, when the width of the timing belt becomes small, the length of meshing in the tooth shape with the belt holding member becomes small and as previously described, the deformation of the belt holding member when a force is applied thereto is great, and the timing belt and the belt holding member become liable to deviate relative to each other.

So, in the present embodiment, the same material is used for the timing belt 8 and the belt holding is member 15.

If the timing belt 8 and the belt holding member 15 are formed of thermoplastic resin, there will be obtained very great exfoliation strength because the two have the property of melting and intermingling with each other and adhering to each other during the integral molding thereof. Accordingly, by the meshing engagement between the teeth of the timing belt 8 and the unevenness of the belt holding member 15 which corresponds to the teeth, and the exfoliation strength of the contact surfaces thereof, it becomes difficult for the timing belt 8 and the belt holding member 15 to deviate relative to each other.

Also, in the present embodiment, the timing belt 8 is formed of thermosetting urethane resin, while the belt holding member 15 is formed of thermoplastic urethane resin. In this case, the two do not melt and intermingle with each other and therefore do not adhere to each other during the integral molding thereof, but yet they are good in mutual closely contacting property relative to a combination of different kinds of resin, and there is obtained very great exfoliation strength.

Also, as previously described, in recent years, the smaller pitch (smaller height of teeth) and smaller belt width of the timing belt have progressed, and particularly when the belt pitch becomes about 1.5 mm or less, the height of the belt teeth becomes about 0.5 mm or less, and this will not hold good unless as previously described, the effect of the integral molding of the belt holding member 15 and the effect of the formation of the timing belt 8 and the belt holding member 15 of the same material are expected. Also, if the width of the belt is great, the force applied to the unevenness corresponding to the teeth of the timing belt 8 will be dispersed and the deformation will become small, but in recent years, 3 mm or less is the mainstream of the belt width, and again here, the formation of the belt holding member by an apt member becomes difficult unless the same system is adopted. Another conceivable method of solution is to heighten the hardness of the belt holding member to thereby restrain the deformation of the belt holding member, but if the hardness of the elastic material is heightened to such a degree as solves the aforementioned problem, the effect of the desired vibration absorption by the elastic material can no longer be expected It is also conceivable to mold only the teeth of the belt with resin of high hardness by two-color molding or the like and form the surroundings thereof of an elastic material, but this will as a matter of course increase the number of members and cause an increase in costs.

In contrast, even when the height of the teeth of the timing belt 8 is 0.5 mm or less and the width of the teeth is 3 mm or less, if the hardness of the belt holding member 15 is 80° or less, the vibration absorbing effect is high and a desired effect can be obtained, and when adopting such a belt holding member 15 at a low cost, the construction of the present embodiment displays a very high effect. The present embodiment has its feature in that whatever shape may be the shape of the teeth of the timing belt 8, that shape of the teeth can be intactly utilized to solve the abovenoted problem at low costs without adding any other member.

Other Embodiments

While in the aforedescribed embodiments, there has been shown an example in which the bosses 8*a* (15*a*) as the projected portions of the belt are provided on the toothed surface of the timing belt 8 and the back opposed thereto, provision may be made of bosses 8*a* (15*a*) having substantially the same central axis in a direction orthogonal to this direction, ie., the widthwise direction of the teeth of the belt.

Also, while in the aforedescribed first embodiment, the central axis of the projected portions passes through the center P of the cross-section of the timing belt in the widthwise direction thereof, the central axis need not be a complete center P in this case, but can be within a range which will not create an angular moment in the belt, and in this point, the central axis of the projected portions can pass through substantially the center of the cross-section of the timing belt in the widthwise direction thereof. Accordingly, "substantially the center" through which the central axis of the projected portions passes includes the complete center of the cross-section of the timing belt in the widthwise direction thereof, and further include the range which will not create an angular moment in the belt near it.

Also, while in the aforedescribed embodiments, an ink jet recording apparatus having the carriage moving apparatus carrying the ink jet head cartridge 2 as recording means thereon has been exemplified, heat transfer recording, thermosensitive recording or the like may be used as the recording means.

The aforedescribed carriage moving apparatus can also be suitably used in a reading apparatus carrying on a carriage reading means for optically reading an original, and reading the original while scanning the carriage.

The present embodiment is constructed as previously described and therefore, in a state in which the projected portions of the belt and the carriage engaging portion are engaged with each other, the central axis of the projected portions passes through substantially the center of the cross-section of the timing belt in the widthwise direction thereof and thus, it is difficult for an angular moment to be applied to the timing belt, and the carriage has no backlash during the transmission of motive power from the timing belt to the carriage.

Also, the projected portions of the belt are made arcuate and the projected portions are adapted to contact with the carriage engaging portion in the arcuate portions, whereby in the engaged portion, the carriage becomes rotatable, and even if stress is applied to the timing belt, it is not transmitted to the carriage, but the vibration transmission preventing effect comes to heighten.

Further, the projected portions of the belt are engaged and embraced by the carriage engaging portion so as to be moderately compressed in a direction parallel to the scanning direction of the carriage, whereby the transmission of vibration can be prevented more effectively.

Also, the carriage and the timing belt are engaged with each other through the elastic member, whereby it becomes possible to effectively absorb the vibration of the timing belt and prevent the transmission of the vibration to the carriage.

What is claimed is:

1. A carriage moving apparatus comprising:

a carriage;

a motor for generating a driving force to drive said carriage;

a belt, engaged with said carriage, for transmitting the driving force generated by said motor to said carriage;

bosses provided on opposite sides of said belt, wherein a central axis of said bosses passes through a substantial center of a cross-section of said belt in a direction orthogonal to a movement direction of said belt; and engaging portions provided on said carriage, for engaging with said bosses.

2. An apparatus according to claim 1, wherein said belt has teeth for engaging with said motor, wherein one of said bosses is provided on a toothed surface side of said belt.

3. An apparatus according to claim 1, wherein said bosses are integrally constructed with said belt.

4. An apparatus according to claim 1, further comprising a belt holding member secured to said belt, wherein said bosses are integrally constructed with said belt holding member.

5. An apparatus according to claim 4, wherein said belt holding member has an elastic material.

6. An apparatus according to claim 5, wherein said belt holding member is of the same material as said belt.

7. An apparatus according to claim 6, wherein said belt is formed of thermosetting urethane resin and said belt holding member is formed of thermoplastic urethane resin.

8. An apparatus according to claim 1, wherein said bosses are compressed and engaged with said engaging portions in the moving direction of said belt.

9. An apparatus according to claim 8, wherein an amount of compression is within a range of 0.5% to 30% relative to the moving direction, and a hardness of said bosses is within a range of 60° to 80°.

10. A recording apparatus for effecting recording using a recording means, said apparatus comprising:

a carriage being movable, carrying the recording means thereon;

a motor for generating a driving force to drive said carriage;

a belt, engaged with said carriage, for transmitting the driving force generated by said motor to said carriage;

bosses provided on opposite sides of said belt, wherein a central axis of said bosses passes through a substantial center of a cross-section of said belt in a direction orthogonal to a movement direction of said belt; and engaging portions, provided on said carriage, for engaging with said bosses.

11. An apparatus according to claim 10, wherein said belt has teeth for engaging with said motor, wherein one of said bosses is provided on a toothed surface side of said belt.

12. An apparatus according to claim 10, wherein said bosses are integrally constructed with said belt.

13. An apparatus according to claim 10, further comprising a belt holding member secured to said belt, wherein said bosses are integrally constructed with said belt holding member.

14. An apparatus according to claim 13, wherein said belt holding member has an elastic material.

15. An apparatus according to claim 14, wherein said belt holding member is of the same material as said belt.

16. An apparatus according to claim 15, wherein said belt is formed of thermosetting urethane resin and said belt holding member is formed of thermoplastic urethane resin.

17. An apparatus according to claim 10, wherein said bosses are compressed and engaged with said engaging portions in the moving direction of said belt.

18. An apparatus according to claim 17, wherein an amount of compression is within a range of 0.5% to 30% relative to the moving direction, and a hardness of said bosses is within a range of 60° to 80°.

19. An apparatus according to claim 10, wherein said recording means is an ink jet recording head capable of discharging ink.

20. An apparatus according to claim 19, wherein said ink jet recording head comprises an electro-thermal converting member for generating thermal energy to be used for ink ejection.

21. A reading apparatus for reading an original document using a reading means, said apparatus comprising:

a carriage being movable, carrying the reading means thereon;

a motor for generating a driving force to drive said carriage;

a belt, engaged with said carriage, for transmitting the driving force generated by said motor to said carriage;

bosses provided on opposite sides of said belt, wherein a central axis of said bosses passes through a substantial center of a cross-section of said belt in a direction orthogonal to a movement direction of said belt; and engaging portions provided on said carriage, for engaging with said bosses.

* * * * *

UNITED STATES PATENT AND TRADEMARK OFFICE

CERTIFICATE OF CORRECTION

PATENT NO. : 6,443,552 B1
DATED : September 3, 2002
INVENTOR(S) : Hiroyuki Inoue et al.

It is certified that error appears in the above-identified patent and that said Letters Patent is hereby corrected as shown below:

Column 1,
Line 39, “expause” should read -- expanse --.

Column 2,
Line 27, “dignity,y” should read -- density --.

Signed and Sealed this

Fifteenth Day of April, 2003

JAMES E. ROGAN
*Director of the United States Patent and Trademark Office*